US010172485B2

(12) United States Patent
Wu et al.

(10) Patent No.: US 10,172,485 B2
(45) Date of Patent: Jan. 8, 2019

(54) DECORATIVE AND CONNECTABLE DISPLAY ARRANGEMENT

(71) Applicants: Yu-Chi Wu, Taipei (TW); Hsiu-Mei Wang, Taipei (TW)

(72) Inventors: Yu-Chi Wu, Taipei (TW); Hsiu-Mei Wang, Taipei (TW)

(73) Assignee: Fourstar Group Inc., Taipei (TW)

( * ) Notice: Subject to any disclaimer, the term of this patent is extended or adjusted under 35 U.S.C. 154(b) by 0 days.

(21) Appl. No.: 15/492,071

(22) Filed: Apr. 20, 2017

(65) Prior Publication Data

US 2017/0215607 A1 Aug. 3, 2017

Related U.S. Application Data

(62) Division of application No. 14/146,227, filed on Jan. 2, 2014, now Pat. No. 9,661,944.

(51) Int. Cl.
*A63H 29/22* (2006.01)
*A47G 7/08* (2006.01)

(52) U.S. Cl.
CPC ..... *A47G 7/08* (2013.01); *Y10T 29/49826* (2015.01)

(58) Field of Classification Search
CPC ..... A47G 7/08
USPC ..... 446/127, 484, 396, 129, 131, 236, 487, 446/69; 40/414
See application file for complete search history.

(56) References Cited

U.S. PATENT DOCUMENTS 2,472,363 A 6/1949 Blackinton
2,565,823 A 8/1951 Pool
2,922,253 A 1/1960 Carter
3,558,138 A 1/1971 Lemelson
3,888,030 A 6/1975 Bradt
4,180,932 A 1/1980 Millard
4,903,424 A 2/1990 Satoh et al.
4,970,810 A 11/1990 Liou
4,983,890 A 1/1991 Satoh et al.
5,056,249 A 10/1991 Sakurai
5,090,936 A 2/1992 Satoh et al.
5,322,717 A 6/1994 Killian
5,775,046 A 7/1998 Fanger et al.
6,045,430 A 4/2000 How
6,845,579 B2 1/2005 Weiser
7,895,779 B2 3/2011 Schnuckle
(Continued)

FOREIGN PATENT DOCUMENTS

CN 101352268 1/2009

*Primary Examiner* — Gene Kim
*Assistant Examiner* — Matthew B Stanczak
(74) *Attorney, Agent, or Firm* — Salter & Michaelson

(57) ABSTRACT

A decorative and connectable display arrangement that includes a housing of multi-sided form having opposed first and second sides and a bottom, an inner support frame that is disposed within the housing and including a cap member having an open top port, and at least one decorative member that is supported within the housing and extends upwardly through the open top port. The decorative member includes a base piece that is pivotally supported in the housing and a stem piece extending from the base piece and extending through the open top port. A solar energy source or panel is supported in the inner support frame and is effective for driving the at least one decorative member in a predetermined motion direction. The housing has 3 on opposed sides thereof an interlock tongue and groove mechanism that enables adjacent ones of the housings to be engaged together.

22 Claims, 9 Drawing Sheets

(56) References Cited

U.S. PATENT DOCUMENTS

| | | | |
|---|---|---|---|
| 2006/0059738 | A1 | 3/2006 | Tsao |
| 2011/0014848 | A1 | 1/2011 | Law |
| 2011/0097964 | A1 | 4/2011 | Law |
| 2014/0227940 | A1 | 8/2014 | Jones |

DECORATIVE AND CONNECTABLE DISPLAY ARRANGEMENT

FIELD OF THE INVENTION

The present invention relates in general to a decorative and connectable display arrangement. More particularly, the invention relates to an arrangement in which housing members, such as a pot arrangement may be interconnected.

BACKGROUND AND SUMMARY OF THE INVENTION

There presently exists solar activated motion products. These are presently provided as single items. It is an objective of the present invention to provide solar motion products that are readily connectable for interesting display combinations.

An object of the present invention is to provide a decorative and connectable display arrangement that may be in the form of a window flower box arrangement in which separate boxes or pots may be readily interconnected and interlocked to form a completed arrangement.

To accomplish the foregoing and other objects, features and advantages of the present invention there is provided a decorative and connectable display arrangement comprising: a housing of substantially quadrilateral form having opposed first and second sides, a bottom and an open top port; at least one decorative member that is supported within the housing and extends upwardly through the open top port; and a solar energy source supported at the housing and for driving the at least one decorative member in a predetermined motion direction. The housing has on at least one of the opposed first and second sides an interlock tongue and groove mechanism that enables adjacent ones of the housings to be engaged together.

In accordance with other aspects of the present invention the housing has a substantially square form with substantially square sides of equal size on all sides; both the opposed first and second sides have an interlock tongue and groove mechanism that enables adjacent ones of the housings to be engaged together; the tongue and groove mechanism includes a dovetail interlock; wherein on the first opposed sides the tongue and groove mechanism is comprised of a single elongated tongue and groove that is engaged by a sliding action between the adjacent housings; wherein on the second opposed sides the tongue and groove mechanism is comprised of a pair of tongue and groove mechanisms that are engaged by a sliding action between the adjacent housings; the pair of tongue and groove mechanisms are spaced apart and engage with a straight groove; the straight groove has end groove segments and a center groove segment that is wider than the end groove segments to enable one of the spaced apart tongues to engage with the center groove segment; including an inner support frame that is disposed within the housing, said solar energy source including a solar panel that is mounted on a cap member that is disposed over the inner support frame and that has the open top port disposed therein; the decorative member includes a base piece that is pivotally supported in the housing and a stem piece extending from the base piece and extending through the open top port; the stem piece supports an end decorative piece and a coil supported in the inner support frame for receiving energy from the solar panel; including a plurality of decorative members each having a base piece and a stem piece, and an attraction member at each base piece and responsive to the energizing of the coil; and wherein the housing has a substantially square form with substantially square sides of equal size on all sides; wherein both the opposed first and second sides have an interlock tongue and groove mechanism that enables adjacent ones of the housings to be engaged together; and wherein the tongue and groove mechanism includes a dovetail interlock.

In accordance with other embodiments of the present invention there is provided a decorative and connectable display arrangement comprising: a housing of multi-sided form having opposed first and second sides and a bottom; an inner support frame that is disposed within the housing and including a cap member having an open top port; and at least one decorative member that is supported within the housing and extends upwardly through the open top port. The decorative member includes a base piece that is pivotally supported in the housing and a stem piece extending from the base piece and extending through the open top port. The decorative and connectable display arrangement further comprises a solar energy source supported in the inner support frame and for driving the at least one decorative member in a predetermined motion direction, wherein the housing has on opposed sides thereof an interlock tongue and groove mechanism that enables adjacent ones of the housings to be engaged together.

In accordance with still other aspects of the present invention the housing is of substantially quadrilateral form having opposed first and second sides, and wherein the housing has a substantially square form with substantially square sides of equal size on all sides; both the opposed first and second sides have an interlock tongue and groove mechanism that enables adjacent ones of the housings to be engaged together; the tongue and groove mechanism includes a dovetail interlock; wherein on the first opposed sides the tongue and groove mechanism is comprised of a single elongated tongue and groove that is engaged by a sliding action between the adjacent housings; and wherein on the second opposed sides the tongue and groove mechanism is comprised of a pair of tongue and groove mechanisms that are engaged by a sliding action between the adjacent housings.

Lastly, in accordance with the present invention there is provided a method of connecting together multiple housings to form a decorative and connectable display arrangement including providing a plurality of housings of multi-sided form; providing an inner support frame that is disposed within the housing and including a cap member having an open top port; disposing at least one decorative member that is supported within the housing and extends upwardly through the open top port; said decorative member including a base piece that is pivotally supported in the housing and a stem piece extending from the base piece and extending through the open top port; controlling the decorative member by means of a solar energy source supported in the inner support frame and for driving the at least one decorative member in a predetermined motion direction; said multiple housings having on opposed sides thereof an interlock tongue and groove mechanism that enables adjacent ones of the housings to be engaged together.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

With reference to the drawings there is illustrated one embodiment of a decorative and connectable display arrangement 10 that is comprised of a housing 12 of multi-sided form having at least opposed first and second sides and a bottom which may be substantially flat. When a single item is used, without any interconnections therebetween this provides a similar clutter appearance as a collection. This is solved in accordance with the present invention by the provision on each item of an interconnecting means. This enables a more aesthetically appealing arrangement of the items and it also enables the individual items to interact to create a unique set of decorative pieces as desired by the purchaser.

Figure 1:
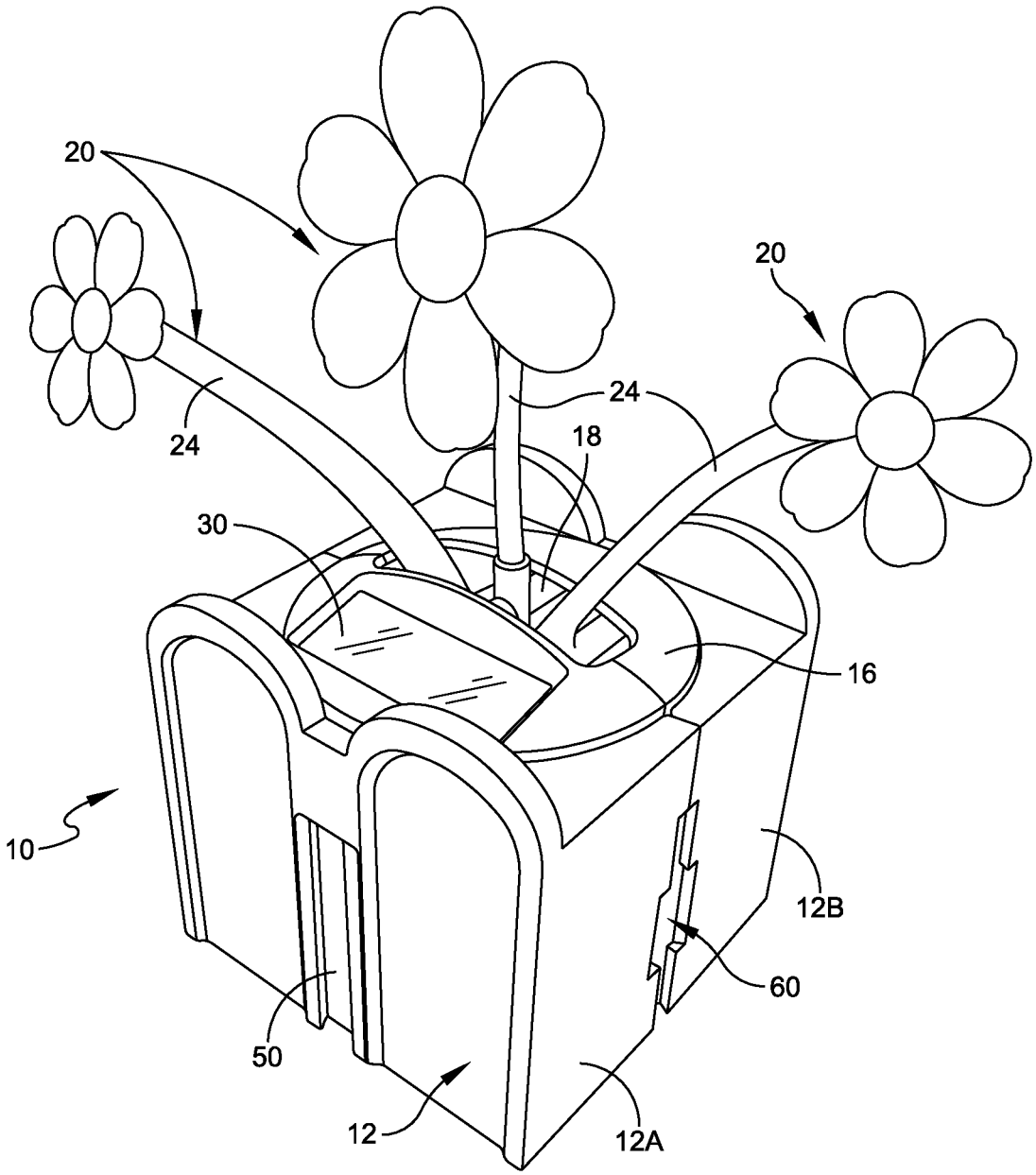
FIG. 1 is a front perspective view of the display of the present invention.
Figure 2:
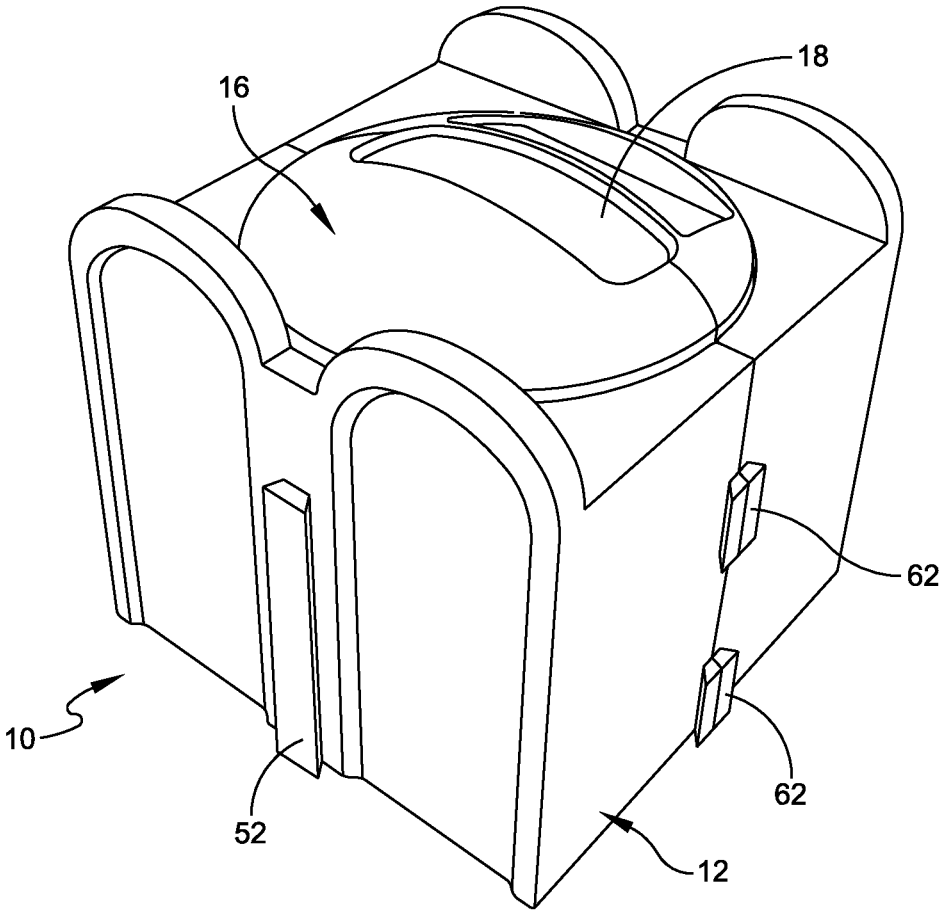
FIG. 2 is a rear perspective view of the display of FIG. 1 with the decorative members removed.
Figure 3:
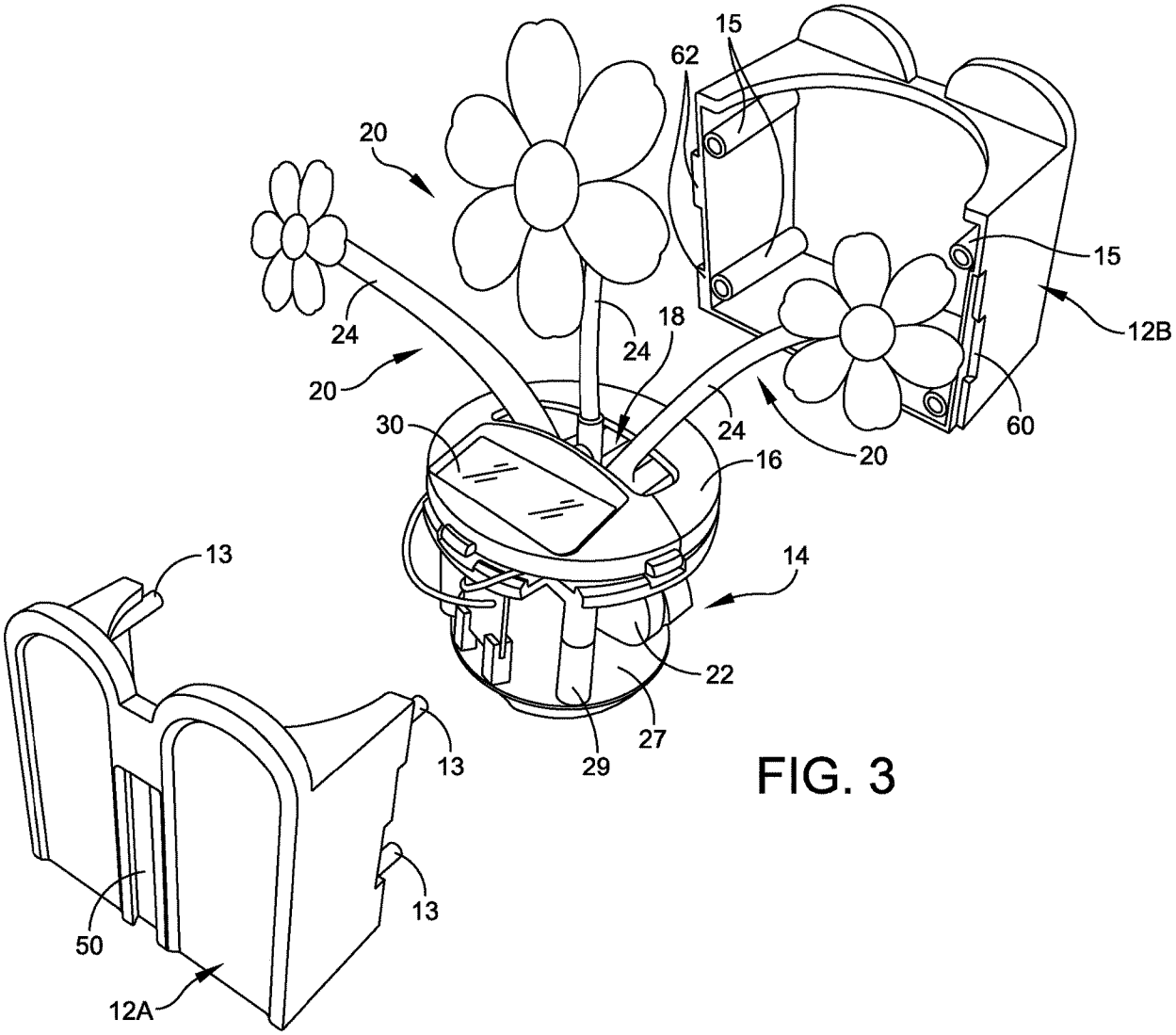
FIG. 3 is an exploded perspective view illustrating the display housing, in a support member and cap member.

Referring now to FIGS. 1-3, the housing 12 is illustrated as exploded away from an inner support frame 14 that is disposed within the housing and that includes a cap member 16 that has an open top port 18. In FIG. 3 the housing 12 is illustrated as comprised of separate housing sections 12A of 12B that interlock by means of a plurality of pins 13 and receiving members 15. These halves 12A and 12B may interlock in a variety of different ways and an adhesive may be used or other fasteners to secure the two halves together. These halves are secured so as to capture therebetween the inner support frame 14 and cap member 16. These housings may be considered as of substantially quadrilateral or substantially square configuration, although, housings may be provided of other shapes such as an oval shape but interconnected in a manner similar to that described herein by interconnecting members on respective housings.

Also illustrated in FIGS. 1-3 are three decorative members 20. Each of these decorative members are supported within the inner support frame 14 and are constructed to extend upwardly through the open port 18 as clearly illustrated in FIGS. 1 and 3.

Each of the decorative members 20 is comprised basically of a base piece 22 that is pivotally supported in the housing. In this regard, in FIG. 5 note the pivot pin 23 associated with one of the base pieces 22. The decorative member further includes a stem piece 24 that extends from the base piece and extends through the open top port 18.

Figure 4:
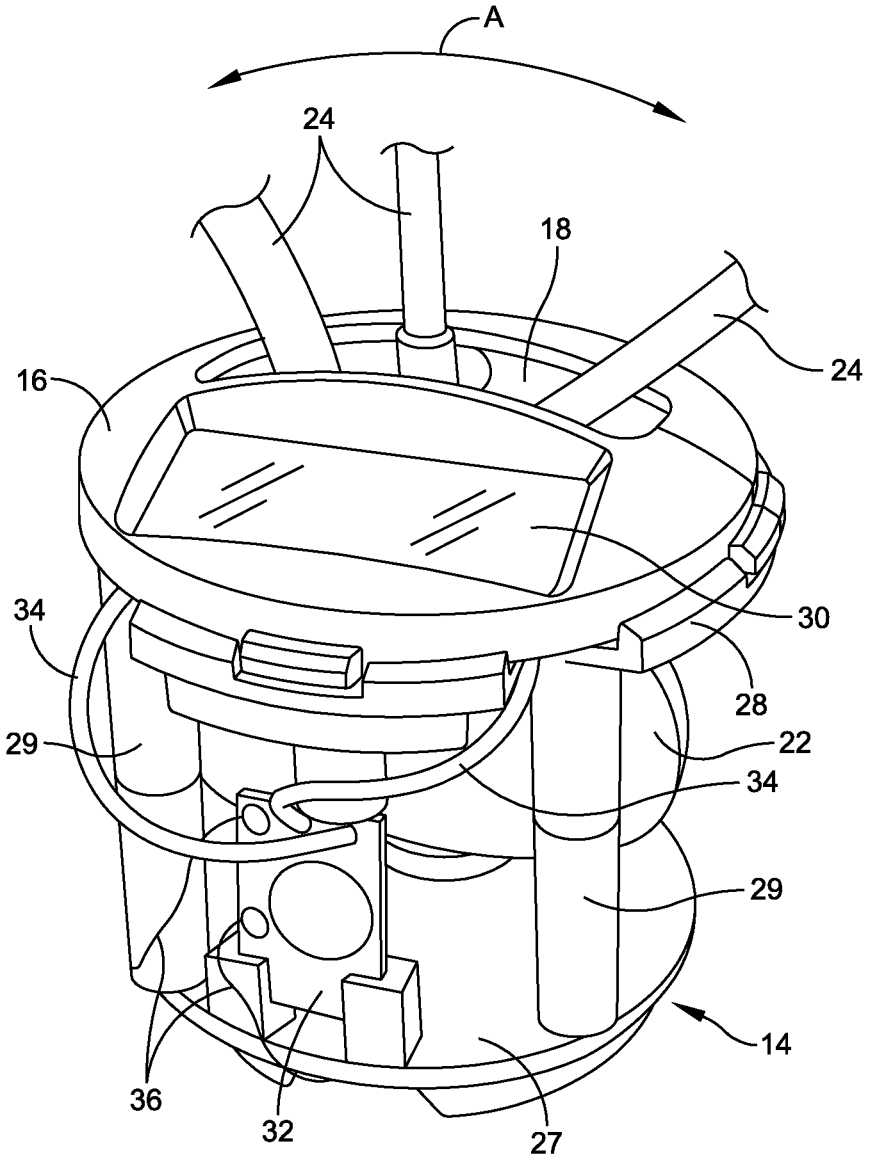
FIG. 4 is a perspective view of the inner support frame and cap member directed at the solar panel.
Figure 5:
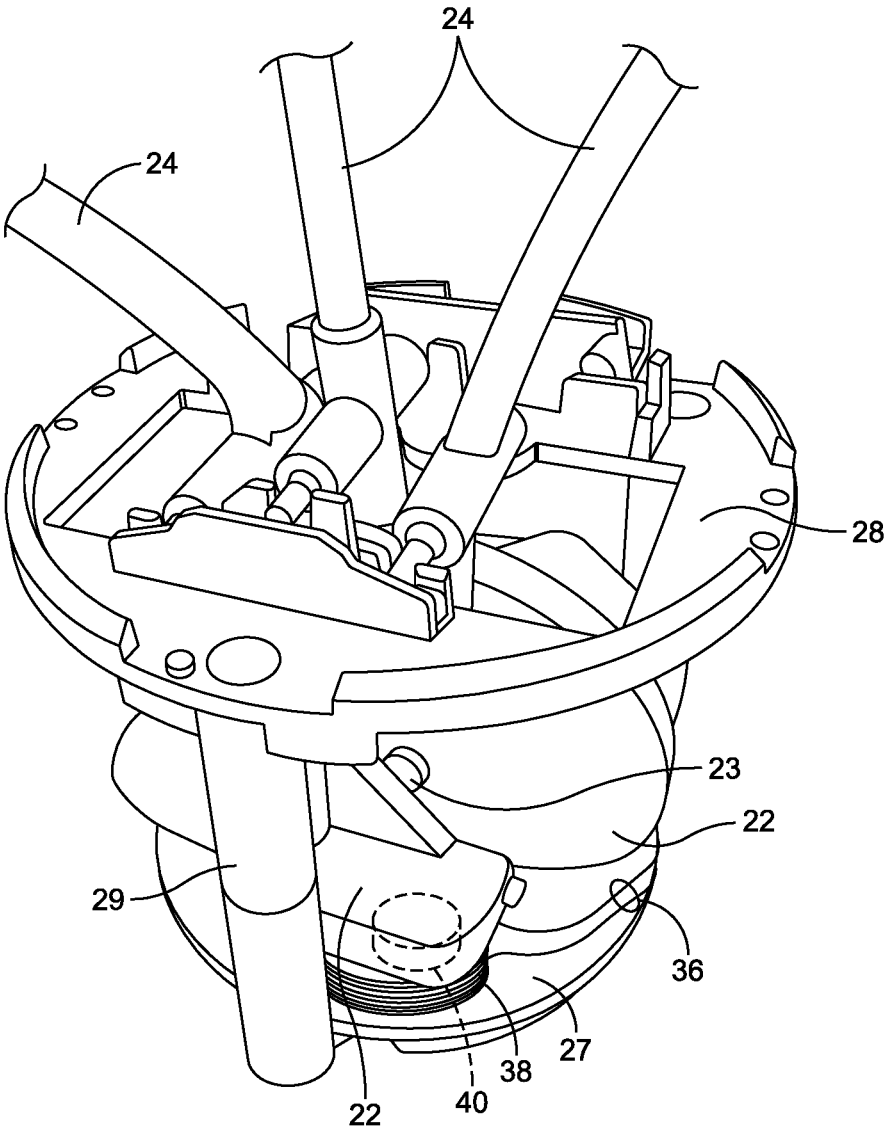
FIG. 5 is a perspective view of the inner support frame with the cap member removed and illustrating the motion coil.

The inner support frame 14 may also include a base 27, a top plate 28 and interconnecting studs 29. This forms a compartment, such as illustrated in FIGS. 4 and 5, in which is disposed the base pieces 22. Each of the base pieces 22 is pivotally supported by means of a pin or the like such as illustrated in FIG. 5. Each of the decorative members is adapted for swinging in a motion direction indicated by arrow A in FIG. 4 in a direction essentially longitudinal of the open top port 18.

The decorative and connectable display arrangement also is one that is preferably solar controlled including a solar energy source. This basic source is illustrated by the conventional solar panel 30 illustrated in FIGS. 1-4. The solar energy source or panel is supported essentially at the cap member 16 and is the energy source for driving at least some of the decorative members 20. As indicated previously, this direction of motion is indicated by the arrow A in FIG. 4. FIG. 4 also illustrates a circuit board 32 mounted at the inner support frame 14 along with wiring 34 that interconnects between the solar panel 30 and the circuit board 32. Additional wiring 36 also connects fro the circuit board to an induction coil 38 that is mounted at the base 27. The coil 38 is mounted in a position of somewhat close proximity to the base pieces 22 of the decorative members 20. The energy from the solar panel is transferred to the coil 38. The coil 38 is representative of an attraction member, establishing a magnetic field for causing the arcing motion of the decorative members. For this purpose, each of the decorative members at a lower portion of their base piece 22 is provided with an attraction member 40 that may be a small magnet polarized properly so as to provide an attraction force between the base piece 22 and the coil 38. The coil 38 is maintained in a fixed stationary position but provides an energy field to attract each of the decorative members so that the decorative members can sweep across the port 18 in the direction of arrow A indicated in FIG. 4.

The housing 12 is also provided with opposed sides that include an interlocking tongue and groove mechanism that enables adjacent ones of the housings to be slidably engaged together. In this regard, refer to FIGS. 6-9 for showing the various means of interlock. In FIGS. 1-5 only a single housing is illustrated whereas in FIGS. 6 and 9, for example, multiple housings are shown in various interlocking patterns. Although a particular interconnecting member has been described herein in the form of a tongue and groove mechanism, it is understood that other interconnecting members may also be provided. These members may even include interconnecting velcro attachments.

Figure 6:
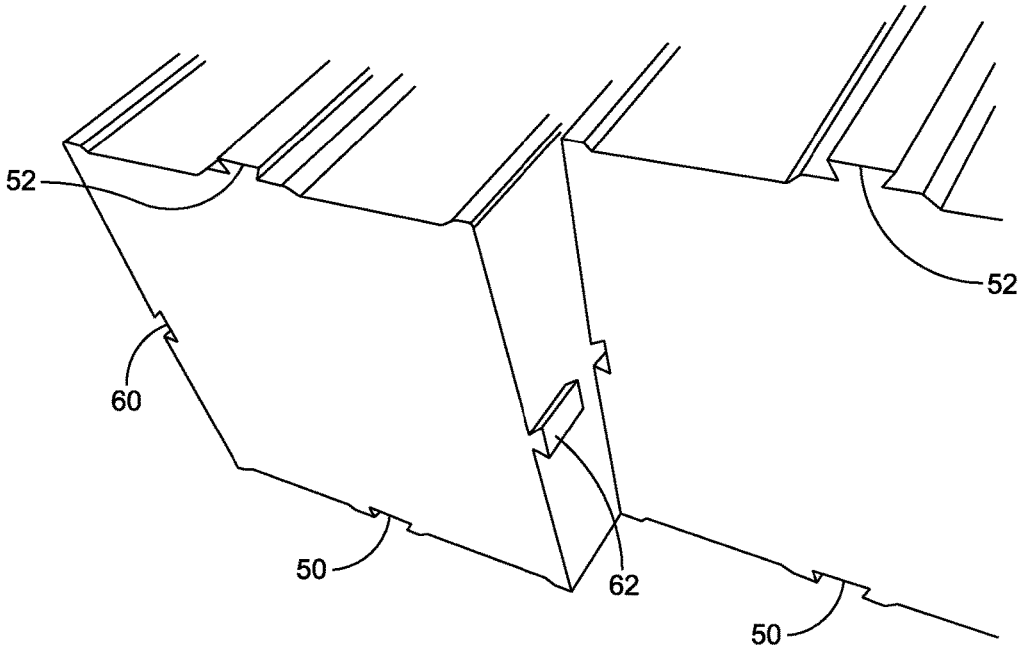
FIG. 6 is a fragmentary perspective view illustrating the interlocking.
Figure 9:
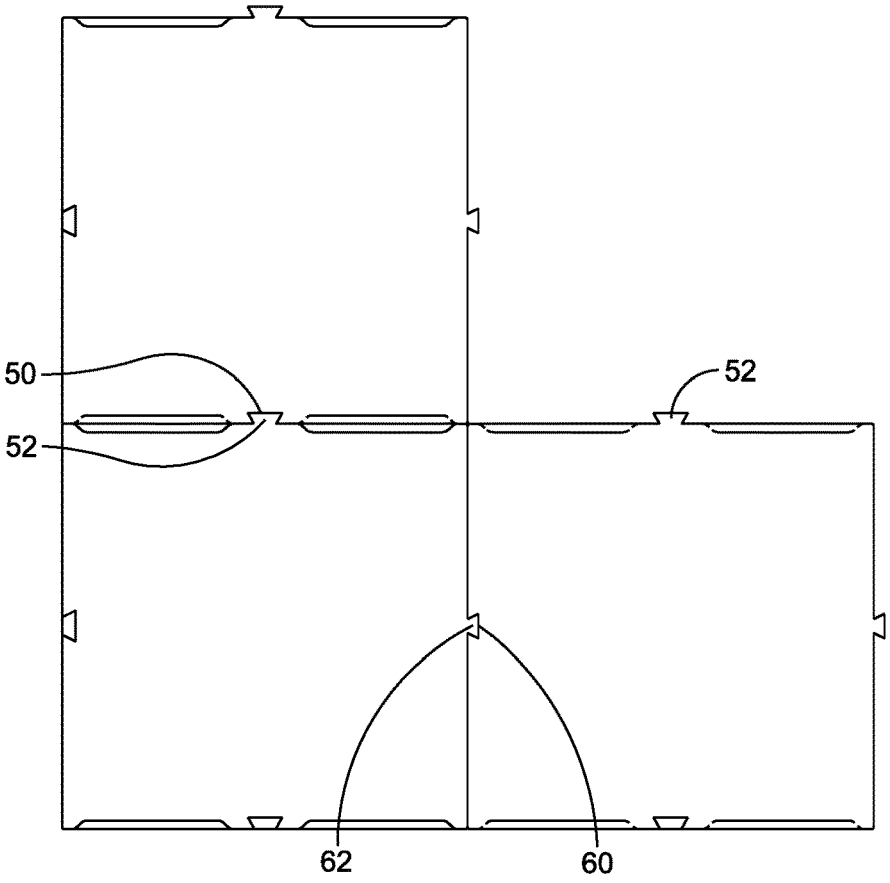
FIG. 9 is a plan view that schematically illustrates the manner in which the interlocking of the housing housings occurs.

On a first pair of opposed sides illustrated in FIGS. 1 and 2, there is provided a dove-tailed groove 50 that is somewhat elongated and that is in the form of a straight dove-tail cross section. This dove-tail groove 50 is illustrated in FIG. 1 and is also illustrated in FIG. 6. FIG. 2 illustrates the dove-tail tongue 52 that is also somewhat elongated and extends in a straight manner from a bottom edge of the housing upwardly, as illustrated in FIG. 2. This interlocking tongue 52 is also shown in FIG. 9 wherein adjacent ones of the housings are interlocked together. This interlocking is provided by simply sliding the tongue 52 into the groove 50 until the adjacent housings are interlocked and maintained with the bottoms thereof flush to each other. Thus, on one of the opposed sides of the housing there is provided a tongue and groove mechanism that is comprised of a single elongated tongue and groove structure that is engaged by a sliding action between the adjacent housings.

Figure 7:
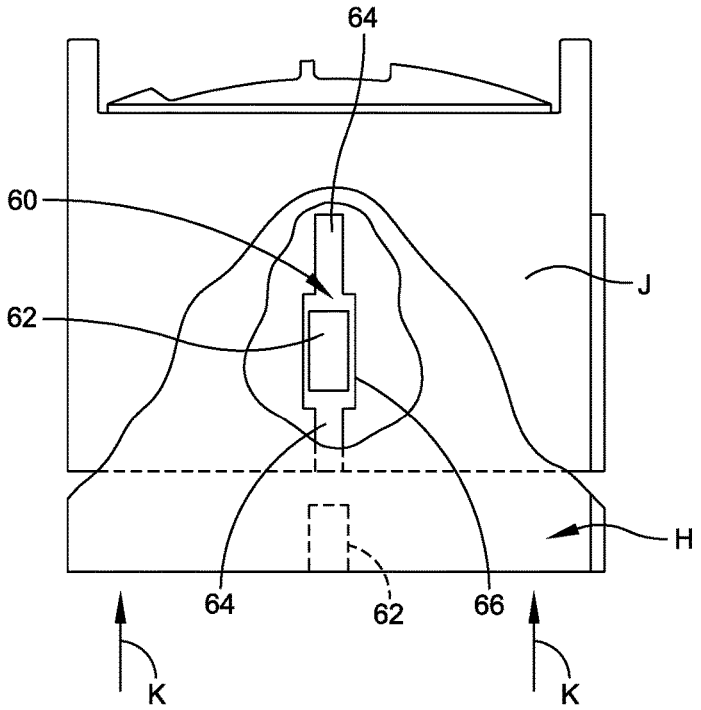
FIG. 7 is a side elevation view showing an interlocking between housings.
Figure 8:
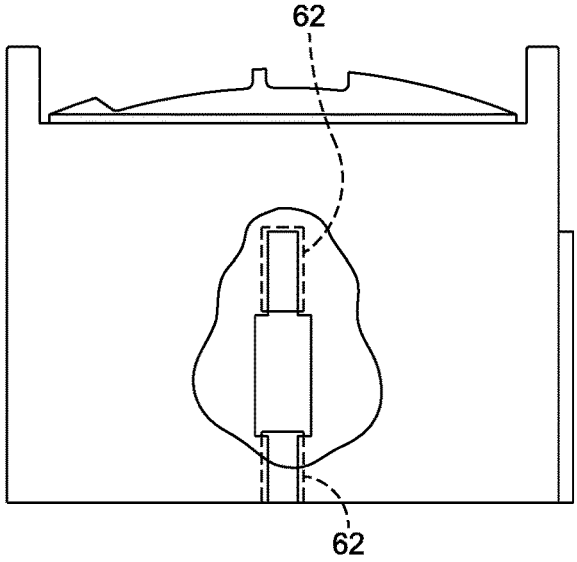
FIG. 8 is a side elevation view illustrating the completed interlock.

There are also second opposed sides of the tongue and groove mechanism as also illustrated in FIGS. 1 and 2. This also is comprised of a stepped groove 60 in FIG. 1 and a pair of spaced apart tongue members 62 as illustrated in FIG. 2. Again, FIGS. 1-5 illustrate only a single housing member while FIGS. 7 and 8, in particular, illustrate the manner in which one of the housing members H has an initial position relative to the housing J. Arrows K illustrate the direction of motion of the housing H. In the initial position the spaced apart tongue members 62 are shown, one below the housing J and the other residing within a wider portion of the stepped groove 60. The groove 60 may be considered as having end groove segments 64 and a center groove segment 66, as illustrated in FIG. 7. FIG. 7 illustrates the center groove segment as being wider than the end groove segments to enable one of the spaced apart tongue members 62 to engage with the center groove segment. FIG. 8 illustrates the position wherein the housing H has now been slid upwardly in the direction of arrows K for full engagement with the housing J so that the tongue 62 now resides captured within the groove 64 at the top and the other lower position tongue 62 is also interlocked at the lower portion of the end groove segment 64. All of the segments 64 and 66 have a dove tail construction. Also, each of the tongues 62 also have a dove tail construction. In this regard refer to FIG. 6.

The interconnecting members described herein are preferably engaged by a sliding action between the interlocking pieces. However, in other embodiments of the present invention such as illustrated herein in FIGS. 12-13 other actions may be provided to provide the interlocking. This may include a snap-fit or other interconnecting mechanism.

Figure 10:
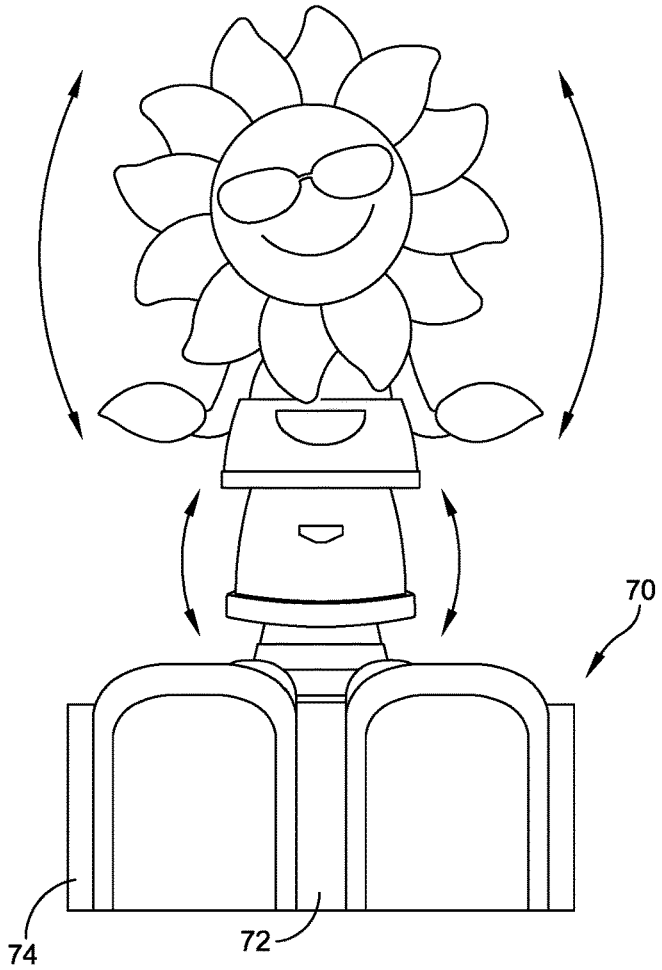
FIG. 10 is a perspective view of a further embodiment of the present invention.
Figure 11:
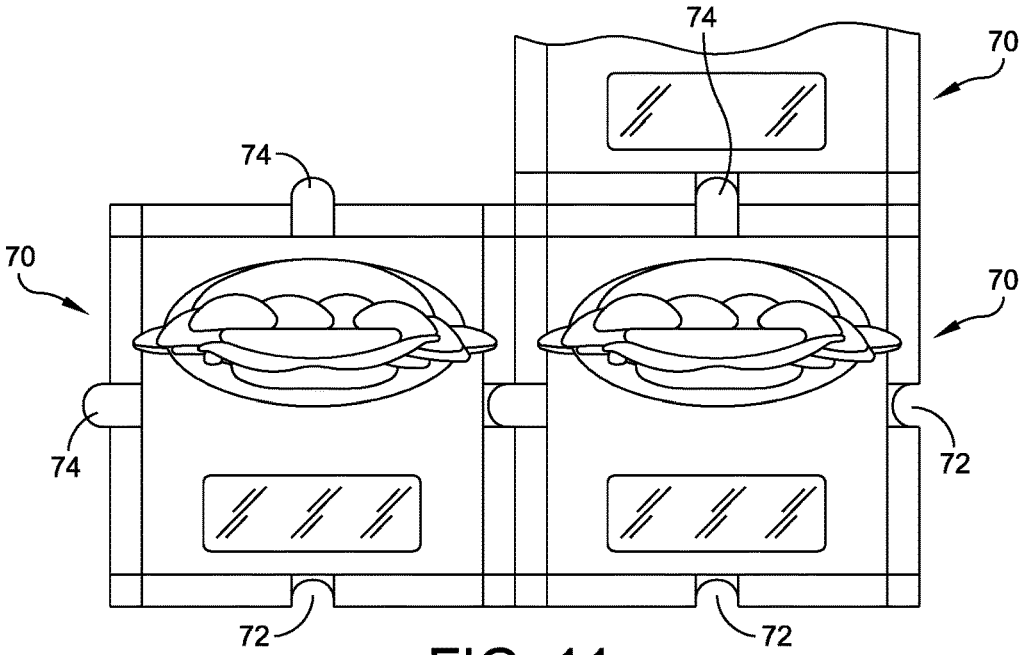
FIG. 11 is a fragmentary plan view of the embodiment of FIG. 10 showing the interconnection between items.

Reference is now made to FIGS. 10 and 11 for a further variation of the present invention. This includes a housing 70 with an associated decorative member extending out of the housing. The interlocking is provided by a groove 72 and a tongue 74. Refer to the fragmentary plan view of FIG. 11 that shows the interlocking. This particular interlocking may be provided by a sliding fit or by a direct snap fit of the tongue 74 into the groove 72.

Figure 12:
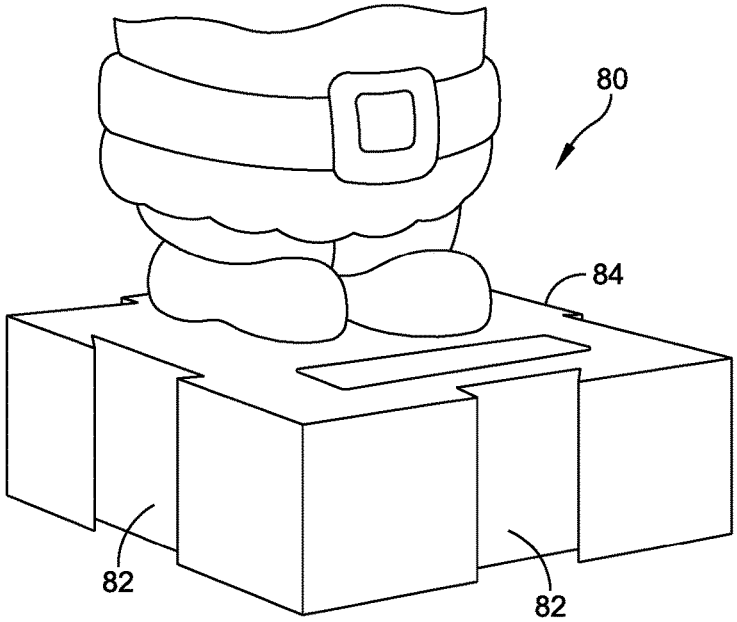
FIG. 12 is a perspective view of still another embodiment of the present invention.
Figure 13:
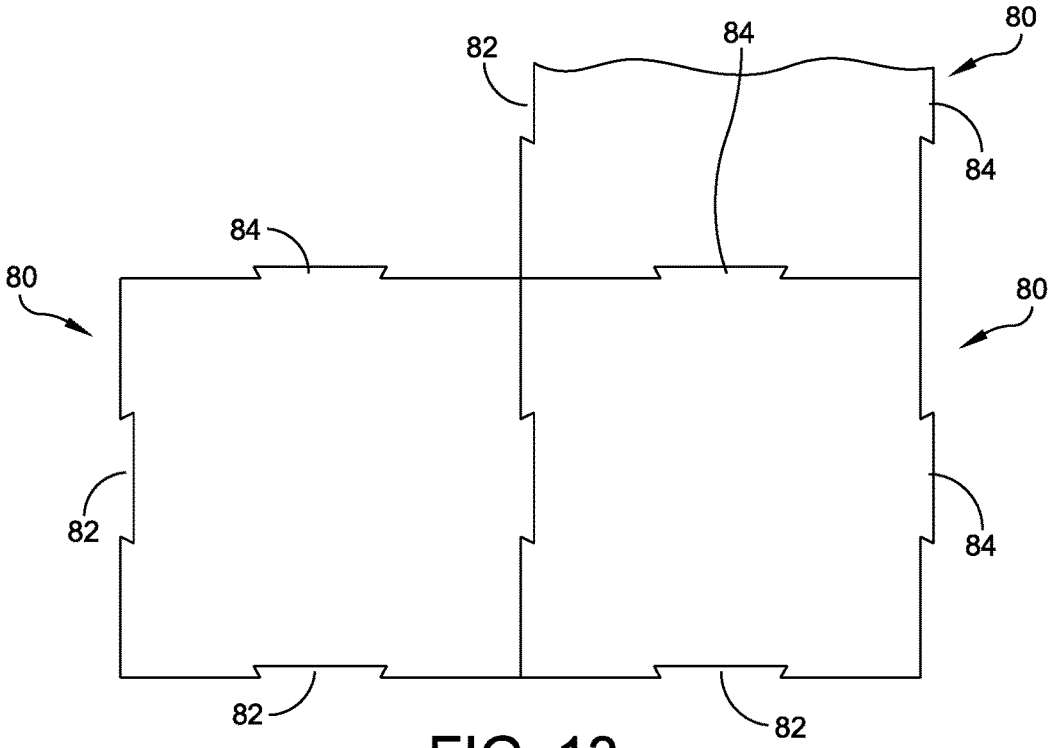
FIG. 13 is a plan view of the embodiment of FIG. 12 showing the interconnection of items.

Reference is now made to FIGS. 12 and 13 for a further variation of the present invention. This includes a housing 80 with an associated decorative member extending out of the housing. The interlocking is provided by a groove 82 and a tongue 84. Refer to the fragmentary plan view of FIG. 13 that shows the interlocking.

Another aspect of the present invention is a method of connecting together multiple housings to form a decorative and connectable display arrangement. This method includes providing a plurality of housings of multi-sided form; providing an inner support frame that is disposed within the housing and including a cap member having an open top port; disposing at least one decorative member that is supported within the housing and extends upwardly through the open top port; said decorative member including a base piece that is pivotally supported in the housing and a stem piece extending from the base piece and extending through the open top port; controlling the decorative member by means of a solar energy source supported in the inner support frame and for driving the at least one decorative member in a predetermined motion direction; said multiple housings having on opposed sides thereof an interlock tongue and groove mechanism that enables adjacent ones of the housings to be engaged together.

Having now described one preferred embodiment of the invention it should be apparent to those skilled in the art that modifications thereof should be contemplated as falling within the scope of the present invention. The housing can be constructed of a number of different types of materials. Also the inner support frame and cap member, although constructed of a plastic material, can also be constructed of a variety of different materials. The decorative members are illustrated as having an end decorative piece in the form of a flower, or another depiction such as in FIG. 12. Various types of decorative members may include an iceberg, a manger setting, flowers, figurines, objects or other structures and characters with dresses or other clothing; not necessarily requiring a stem or leg. However, a variety of other different decorative end pieces may be employed. Although three decorative members are illustrated, as few as a single decorative member may be employed.

What is claimed is:

1. A method of connecting together multiple housings to form a decorative and connectable display arrangement including providing a plurality of housings of multi-sided form; providing an inner support frame that is separate from and that is disposed within the housing and including a cap member having an open top port; disposing at least one decorative member that has a support within the housing and extends upwardly through the open top port; said decorative member including a base piece that is pivotally supported in the housing from the inner support frame and a stem piece extending from the base piece and extending through the open top port; said stem piece that extends through the open top port being user visible; controlling the decorative member by means of a solar energy source supported in the inner support frame and for driving the at least one decorative member in a predetermined motion direction; said multiple housings having on opposed sides thereof an interlock tongue and groove mechanism that enables adjacent ones of the housings to be engaged together.

2. The method of claim 1 wherein the inner support frame is provided with a base and a top plate that is spaced above the base and pivotally supporting the base piece of the decorative member in the housing by means of a pivot pin.

3. The method of claim 2 including disposing the pivot pin that supports the base piece of the decorative member at a location between the base and top plate of the inner support frame.

4. The method of claim 3 including mounting a decorative piece from a distal free end of the stem piece.

5. The method of claim 4 wherein the top port comprises an elongated open top port and further including providing the cap member with a peripheral edge, and accommodating the peripheral edge of the cap member within a top opening of the housing.

6. The method of claim 5 including mounting the solar panel on the cap member adjacent to the elongated open top port of the cap member and mounting an induction drive coil in proximity to the base piece for receiving energy from the solar panel and causing an arcing motion of the decorative stem along the elongated open top port of the cap member.

7. The method of claim 6 including providing each housing having on the opposed first and second sides an interconnecting member that enables adjacent ones of the housings to be engaged together and providing the interconnecting member on the first side is a tongue mechanism and the interconnecting member on the second side is a groove mechanism with the engagement of the housings being by a sliding action between the juxtaposition housings.

8. The method of claim 1 including providing said cap member with a top recess in a top surface thereof with said solar panel being disposed in the top recess, the top recess being elongated and the solar panel being similarly elongated, said recess and solar panel extending substantially in parallel to the elongated open top port in the cap member.

9. The method of claim 8 including providing a circuit board, mounting the circuit board at the inner support frame along with wiring that interconnects between the solar panel and the circuit board, mounting an induction coil in proximity to the base piece for receiving energy from the solar panel, providing additional wiring that also connects from the circuit board to the induction coil that is mounted at the base of the inner support frame.

10. The method of claim 9 including transferring the energy from the solar panel to the induction coil, said induction coil being representative of an attraction member for establishing a magnetic field for causing the arcing motion of the decorative member, said attraction member being a magnet polarized so as to provide an attraction force between the base piece and the coil.

11. The method of claim 10 including maintaining the induction coil in a fixed stationary position and providing an energy field from the induction coil to attract the decorative member so that the decorative member can sweep across the open top port of the cap member.

12. The method of claim 1 including providing the top plate of the inner support frame with an upwardly turned peripheral ledge having spaced apart slots, the cap member having its peripheral edge provided with spaced apart tabs, and the tabs are interlocking with the slots so as to keep the cap member in the desired rotational position and fixed in that position.

13. A method of constructing a housing that is adapted to form a decorative display arrangement including providing a housing of multi-sided form; providing an inner support frame that is separate from and that is disposed within the housing and including a cap member having an open top port; disposing at least one decorative member that has a support within the housing and extends upwardly through the open top port; said decorative member including a base piece that is pivotally supported in the housing from the inner support frame and a stem piece extending from the base piece and extending through the open top port; said stem piece that extends through the open top port being user visible; controlling the decorative member by means of a solar energy source supported in the inner support frame and for driving the at least one decorative member in a predetermined motion direction.

14. The method of claim 13 including providing the inner support frame with a base and a top plate that is spaced above the base and pivotally supporting the base piece of the decorative member in the housing by means of a pivot pin.

15. The method of claim 14 including disposing the pivot pin that supports the base piece of the decorative member at a location between the base and top plate of the inner support frame.

16. The method of claim 13 including providing the top plate of the inner support frame with an upwardly turned peripheral ledge having spaced apart slots, the cap member having its peripheral edge provided with spaced apart tabs, and the tabs are interlocking with the slots so as to keep the cap member in the desired rotational position and fixed in that position.

17. The method of claim 13 including providing said cap member with a top recess in a top surface thereof with said solar panel being disposed in the top recess, the top recess being elongated and the solar panel being similarly elongated, said recess and solar panel extending substantially in parallel to the elongated open top port in the cap member; including providing a circuit board, mounting the circuit board at the inner support frame along with wiring that interconnects between the solar panel and the circuit board, mounting an induction coil in proximity to the base piece for receiving energy from the solar panel, providing additional wiring that also connects from the circuit board to the induction coil that is mounted at the base of the inner support frame; including transferring the energy from the solar panel to the induction coil, said induction coil being representative of an attraction member for establishing a magnetic field for causing the arcing motion of the decorative member, said attraction member being a magnet polarized so as to provide an attraction force between the base piece and the coil; and including maintaining the induction coil in a fixed stationary position and providing an energy field from the induction coil to attract the decorative member so that the decorative member can sweep across the port.

18. A method of connecting together multiple housings to form a decorative and connectable display arrangement including providing a plurality of housings of multi-sided form; said plurality of housings including at least two like juxtaposition housings with each housing having opposed first and second sides each having an interlock mechanism that enables adjacent ones of the housings to be engaged together, a bottom and an open top with an opening, providing an inner support frame that is disposed within the housing and including a cap member having an elongated open top port that is constructed and arranged to be accommodated within the top opening of each respective housing; providing each said housing as comprised of like housing sections that each include interconnecting pieces that interlock in order to form the respective housing, to form the housing opening once interlocked and to capture the inner support frame therebetween; disposing at least one decorative member that is supported within the housing and extends upwardly through the elongated open top port of the cap member; said decorative member including a stem piece extending through the elongated open top port of the cap member; controlling the decorative member by means of a solar energy source for driving the at least one decorative member in a predetermined motion direction so that the decorative stem swings in a direction essentially longitudinal of the elongated open top port of the cap member; wherein the step of controlling the decorative member includes providing the solar energy source as a solar panel mounted on the cap member and an induction drive coil mounted in proximity to a base of the decorative stem for receiving energy from the solar panel and causing an arcing motion of the decorative stem along the elongated open top port of the cap member; and wherein the step of disposing at least one decorative member includes disposing a plurality of decorative members each including a decorative stem that is supported by a respective pivot pin; and wherein the step of controlling the decorative member includes controlling all of the decorative stems to have the same arcing motion along the elongated open top port of the cap member.

19. The method of claim 18 wherein the plurality of decorative members have their respective decorative stems spacedly disposed along the elongated open top port of the cap member.

20. The method of claim 18 wherein all of the pivot pins that support each decorative stem extend in parallel to each other.

21. The method of claim 20 wherein each of the pivot pins are arranged spaced apart.

22. The method of claim 18 wherein all of the pivot pins that support each decorative stem extend in parallel to each other.

* * * * *